US007478640B2

(12) United States Patent
Saida et al.

(10) Patent No.: US 7,478,640 B2
(45) Date of Patent: Jan. 20, 2009

(54) HAIR IRON

(75) Inventors: Itaru Saida, Osaka (JP); Hisashi Kitamura, Osaka (JP); Akinobu Mizuta, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 299 days.

(21) Appl. No.: 10/474,515

(22) PCT Filed: Jan. 17, 2003

(86) PCT No.: PCT/JP03/00333

§ 371 (c)(1),
(2), (4) Date: Oct. 22, 2003

(87) PCT Pub. No.: WO03/061425

PCT Pub. Date: Jul. 31, 2003

(65) Prior Publication Data

US 2004/0129288 A1 Jul. 8, 2004

(30) Foreign Application Priority Data

Jan. 18, 2002 (JP) ..... 2002-010832
Feb. 4, 2002 (JP) ..... 2002-027315

(51) Int. Cl.
*A45D 6/06* (2006.01)

(52) U.S. Cl. ..... 132/228

(58) Field of Classification Search ..... 132/118, 132/112, 116, 148, 152, 154, 271, 272, 228, 132/223; 34/96, 97; 219/222, 225, 226; 607/79; 15/104.002, 246.3, 344, 345, 39.5, 15/40; 392/384, 385
See application file for complete search history.

(56) References Cited

U.S. PATENT DOCUMENTS 2,098,593 A * 11/1937 Quinio ..... 132/118
4,029,685 A * 6/1977 Priddy ..... 560/302
4,368,376 A * 1/1983 Andis ..... 219/222
4,936,027 A * 6/1990 Tsuji ..... 34/90
5,223,694 A * 6/1993 Tsuji et al. ..... 219/225
5,743,278 A * 4/1998 Ookura et al. ..... 132/210

(Continued)

FOREIGN PATENT DOCUMENTS

EP 0909539 4/1999

(Continued)

OTHER PUBLICATIONS

English Language Abstract of JP3-51001.

(Continued)

*Primary Examiner*—Robyn Doan
*Assistant Examiner*—Rachel A Running
(74) *Attorney, Agent, or Firm*—Greenblum & Bernstein, P.L.C.

(57) ABSTRACT

A hair iron can give hair a sufficient amount of negative ions. The hair iron has a grip, and a hair-care section connected to the grip, having a heater for generating heat to hair for hair dressing. Further, it has a negative ion generator which generates negative ions due to discharge around an electrode therein to emit them toward hair held by the hair-care section. The hair-care section has a bar-like shape, and the heater is fixed to an outer surface of the bar-like shape. Then, by winding hair to the hair care section in the hair iron, hair dressing can be performed efficiently.

12 Claims, 16 Drawing Sheets

U.S. PATENT DOCUMENTS

| | | | | | |
|---|---|---|---|---|---|
| 5,805,406 | A | * | 9/1998 | Mailand | 361/212 |
| 5,941,253 | A | | 8/1999 | Kaizuka | |
| 5,975,090 | A | * | 11/1999 | Taylor et al. | 132/116 |
| 6,029,677 | A | * | 2/2000 | Nanba et al. | 132/225 |
| 6,119,702 | A | * | 9/2000 | Habibi | 132/224 |
| 6,182,671 | B1 | * | 2/2001 | Taylor et al. | 132/116 |
| 6,325,072 | B1 | | 12/2001 | Smetana | |
| 6,393,718 | B1 | * | 5/2002 | Harris et al. | 34/96 |
| 6,672,315 | B2 | * | 1/2004 | Taylor et al. | 132/116 |
| 6,910,281 | B2 | * | 6/2005 | Ito | 34/96 |

FOREIGN PATENT DOCUMENTS

| | | | |
|---|---|---|---|
| JP | 3-51001 | | 3/1991 |
| JP | 6-315414 | * | 11/1994 |
| JP | 2534856 | | 2/1997 |
| JP | 3047352 | | 1/1998 |
| JP | 10295432 | | 11/1998 |
| JP | WO 02/051282 | * | 7/2002 |

OTHER PUBLICATIONS

Partial translation of JP3047352.
English Language Abstract of JP10-295432.

* cited by examiner

HAIR IRON

BACKGROUND OF THE INVENTION

1. Field of the Invention

The present invention relates to a hair iron used for hair-care such as hair dressing by contacting hair to a heated hair-care section attached to a grip.

2. Description of Prior Art

A hair iron are used for hair care such as hair dressing by heating a hair-care section fixed to a grip and by contacting hair with the heated hair-care section (for example, Japanese Utility Model No. 3,047,352). FIG. 16 shows a prior art hair iron 200. The hair iron 200 has a form similar to a pair of scissors as a whole. A user inserts hair between a pair of a rod 22 and a glove 23 of the hair-care section 2 and seizes the pair of grips 1 with hand. Then, hair is heated by a heater (not shown) in the rod 22, and the hair iron can be used hair care such as hair dressing.

Further, planes 24 of the rod 22 and groove 23 of the hair iron 200 for holding hair between them are coated with a fluoroplastic mixed with powders of multi-element minerals. Then, negative ions generated at the planes adhere to hair and suppress damages of the hair held by the planes. Thus, a good quality of hair dressing can be performed.

However, in the electric iron 200 for hair dressing, an amount of generated negative ions is very small, depending on the thin coating, and an effect of the negative ions on hair is small. Further, because negative ions are generated constantly at the coating, it is not possible for a user to perform hair dressing without adhering negative ions to hair.

Further, a curling iron which can curl hair by winding hair to the hair-care section is also known. However, it is also desired to efficiently wind and reform hair by the hair-care section.

SUMMARY OF THE INVENTION

An object of the invention is to provide a hair iron which can enjoy an effect of a sufficient quantity of negative ions on hair. Another object of the invention is to provide a hair iron having a selector for a user to generate negative ions or not. A further object of the invention is to provide a hair iron which efficiently winds and reforms hair by a hair-care section.

A hair iron according to the invention has a grip, a hair-care section connected to the grip, having a heater for generating heat to hair for hair dressing, and a negative ion generator which generates negative ions due to discharge around an electrode therein to emit them toward hair held by the hair-care section. A user makes hair contact to heating planes heated by the heater for hair care such as hair dressing. Further, a large quantity of negative ions can be generated by the negative ion generator, so that a large quantity of negative ions are adhered to hair. This suppresses damage to hair, and a user can perform hair dressing of a good quality.

Preferably, the hair iron has an outlet near the electrode to emit the negative ions therethrough. Then, efficiency for emitting negative ions can be enhanced. That is, negative ions generated around the electrode are not liable to adhere to an inner wall of the housing, and a large quantity of as-generated negative ions can be emitted towards hair.

Preferably, in the hair iron, the hair-care section has a bar-like shape, and the heater is set to an outer surface of the bar-like shape. Thus, the internal structure of the hair care section can be simplified.

Preferably, the hair iron has the negative-ion generator built in the grip, and the grip further has an outlet opening to the hair-care section to emit the negative ions towards the hair-care section. Thus, negative ions can be adhered to hair efficiently.

Preferably, in the hair iron, the hair-care section is aligned along the same axial line with the grip of bar-like shape, and an opening direction of the outlet is inclined within a range of ten to thirty degrees relative to an axial line of the grip. Then, negative ions can be adhered to the whole hair held by the hair care section.

Preferably, in the hair iron, bristles are provided on an outer surface of the hair-care section of bar-like shape at positions farther than a predetermined length from the outlet. Preferably, in the hair iron, bristles are provided on an outer surface of the hair care section of the bar-like portion, and lengths of bristles at positions within a predetermined length from the outlet are shorter than lengths of the bristles at positions farther than the predetermined length from the outlet. If long bristles are set near the outlet, they are charged negatively, so that they repel negative ions passing through the long bristles. Such phenomenon can be prevented. Then, negative ions can be adhered effectively on the entire hair.

The invention further provides a hair iron of holding type. That is, the hair iron consists of first and second blocks which can contact with or be separated from each other for holding hair between them, and planes for holding hair between them are provided on planes of the first and second blocks opposing to each other. The first block has a part of the grip and a part of the hair-care section, and the second block has the remaining part of the grip and the remaining part of the hair-care section, and the holding planes are operated as heating portions.

Preferably, the hair iron further has at least one outlet for emitting negative ions at a position wherein the hair crosses the holding plane. In the hair iron of holding type, hair is held between holding planes of the hair care section so that the hair extends along the right and left direction of the hair care section. Then, the hair iron is slid to the end of the hair. Thus, negative ions can be emitted to the hair just before and just after passing the hair care section.

Preferably, the hair iron further has two outlets for emitting negative ions at a position in a direction towards the base of hair and at another position in a direction towards the top of hair. Then, negative ions can be emitted to hair before and after passing the hair care section.

Preferably, the hair iron further has an outlet for emitting the negative ions at the holding plane. Then, negative ions can be emitted strongly to hair held by the hair care section.

Preferably, in the hair iron, the outlet is opened in a direction away from the holding plane. Then, negative ions can be emitted in a wide range to hair held by the hair care section.

Preferably, in the hair iron, the outlet is opened in a direction to emit negative ions in a direction perpendicular to hair. Then, negative ions can be emitted strongly to hair held by the hair care section.

Preferably, the hair iron further comprises a plurality of outlets for emitting negative ions, the outlets being opened along the holding plane in a direction wherein hair crosses the holding plane. Then, negative ions can be emitted in a wide range to hair held by the hair care section.

Preferably, in the hair iron, the negative ion generator is built in the hair-care section. Further another outlet is provided to emit the negative ions towards the hair-care section. Then, the internal structure of the hair care section can be simplified. Further, because the outlet is opened to the hair care section, negative ions can be adhered to hair.

Preferably, the hair iron according to the invention further has a plurality of bristles provided at an outer plane of the hair care section, a steam generator which generates steam, an ejector which ejects the steam generated by the steam generator, the ejector being provided at the bases of the plurality of bristles, and a ring which diffuses the steam generated by the steam generator, the ring being provided near the bases of the plurality of bristles. Because of the rings, it is prevented that hair is heated excessively or that scalp is burnt. The, a large quantity of steam can be supplied to hair efficiently.

Preferably, in the hair iron, an outer peripheral plane of the hair care section has a first curved plane having a first curvature of radius and a second curved plane having a second curvature of radius smaller than the first curvature of radius. The hair iron further has bristles having a first height in the first curved plane and bristles having a second height lower than the first height in the second curved plane. By using the bristles of the first height in the first curved plane, brushing for straightening or reforming to straight hair can be performed easily. Further, by using the bristles of the second or lower height in the second curved plane, winding of hair to the hair care section by adjusting hair flow or curling of hair can be performed easily.

Preferably, in the hair iron, the first curved plane occupies a portion in the outer peripheral plane in correspondence to a range between 90 and 120 degrees around the axial line of the hair care section. Therefore, the bar-like shape of the hair care section can be formed so as not to prevent winding hair. Further, hair can be brushed in a wide range, and brushing can be performed effectively.

Preferably, another type of the hair iron further has a steam generator which generates steam and an ejector which ejects the steam generated by the steam generator. Then, hair can be extended on brushing.

Preferably, the above-mentioned hair iron further has a switch for selectively operating the heater at the hair-care section and the negative ion generator. Then, a user can use the hair iron according to his or her desire, for example, to perform hair dressing without adhering negative ions to hair.

BRIEF DESCRIPTION OF THE DRAWINGS

The embodiments according to the invention are explained with reference to the accompanying drawings, and in which.

DETAILED DESCRIPTION OF THE PREFERRED EMBODIMENTS

Figure 1:
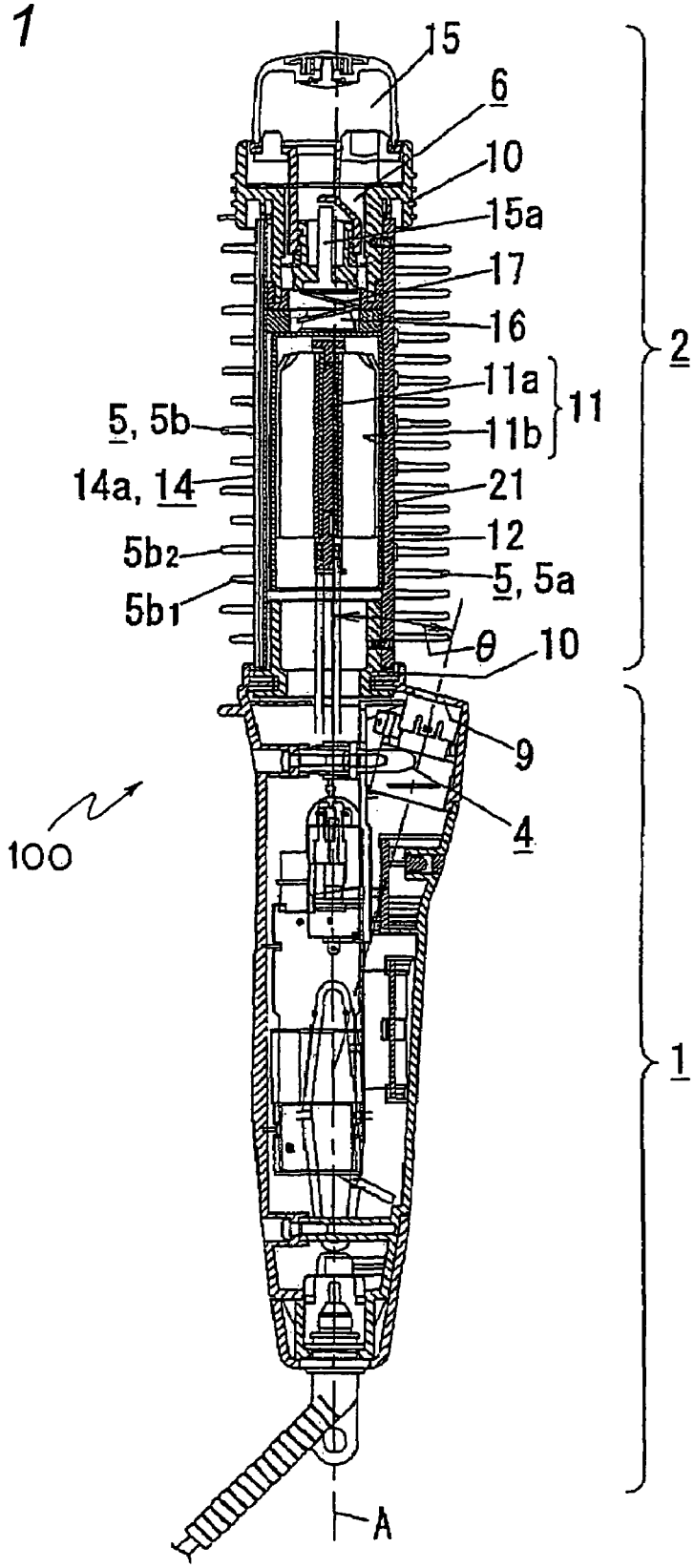
FIG. 1 is a front sectional view of a hair iron according to the invention.

Referring now to the drawings, embodiments of the invention are explained wherein like reference characters designate like or corresponding parts throughout the several views.

Figure 2:
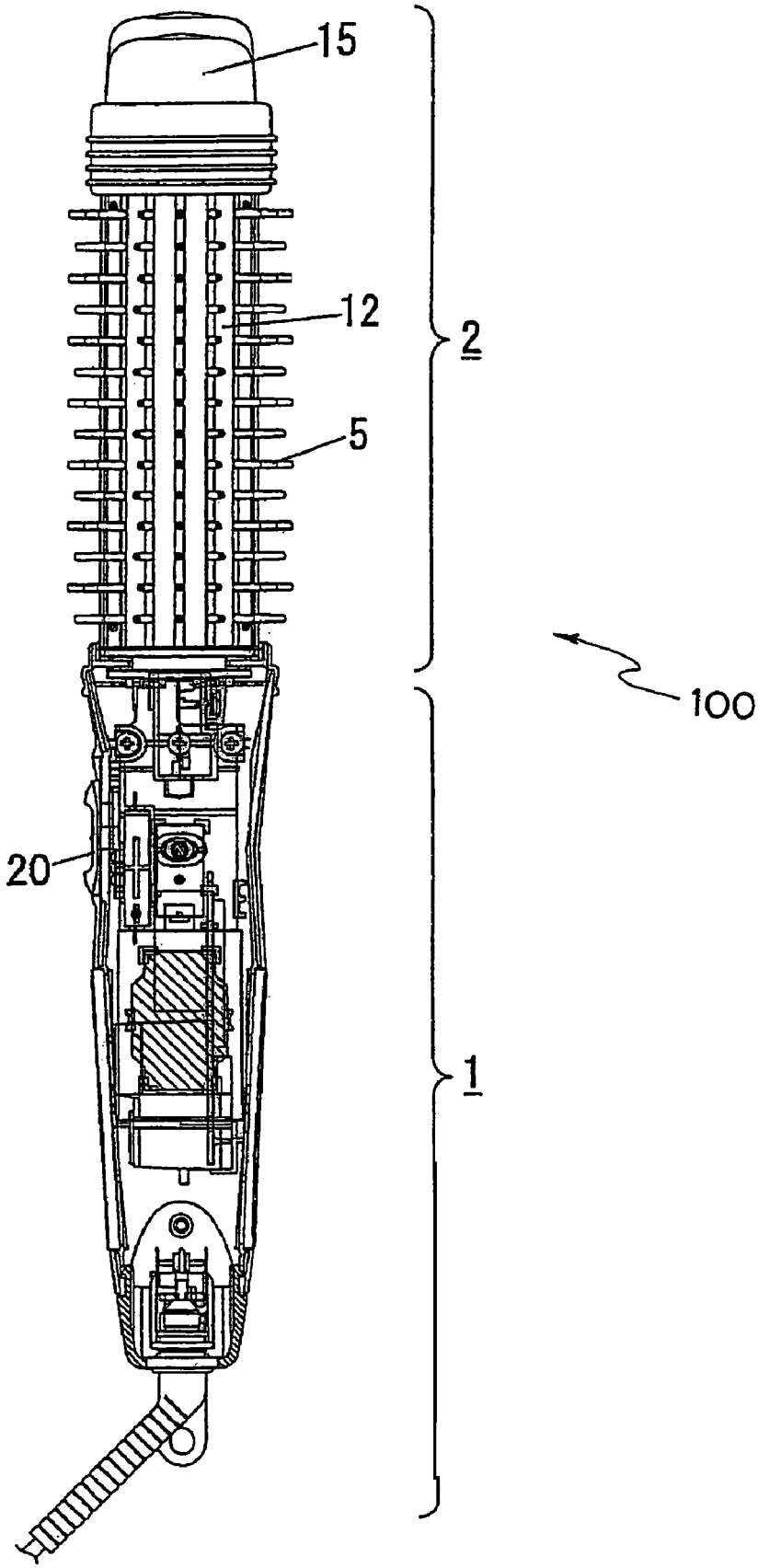
FIG. 2 is a side view, partly in cross section, of a hair iron.
Figure 3A:
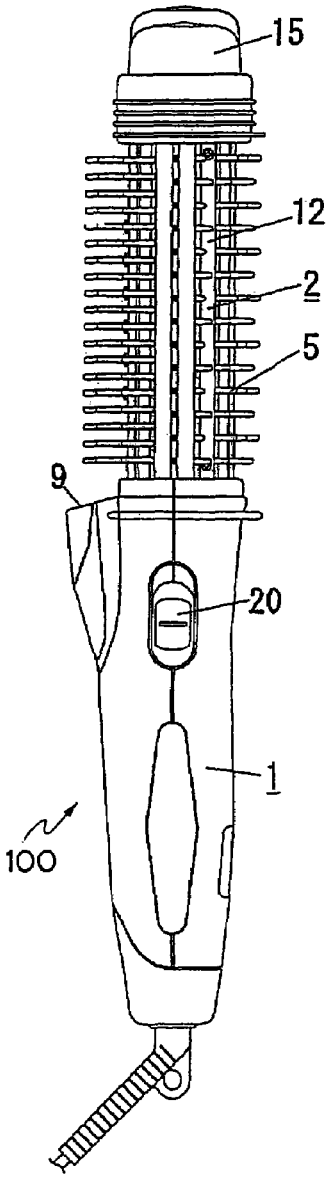
FIGS. 3A, 3B and 3C are front view, a right side view and a left side view of a hair iron.
Figure 3B:
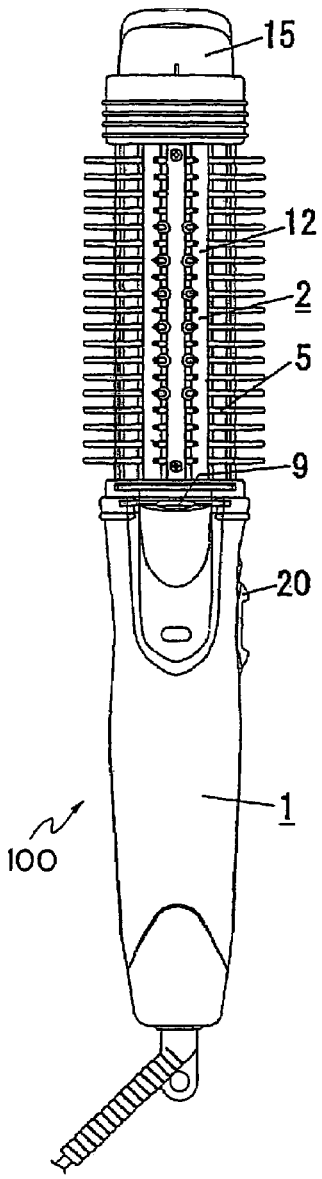
Figure 3C:
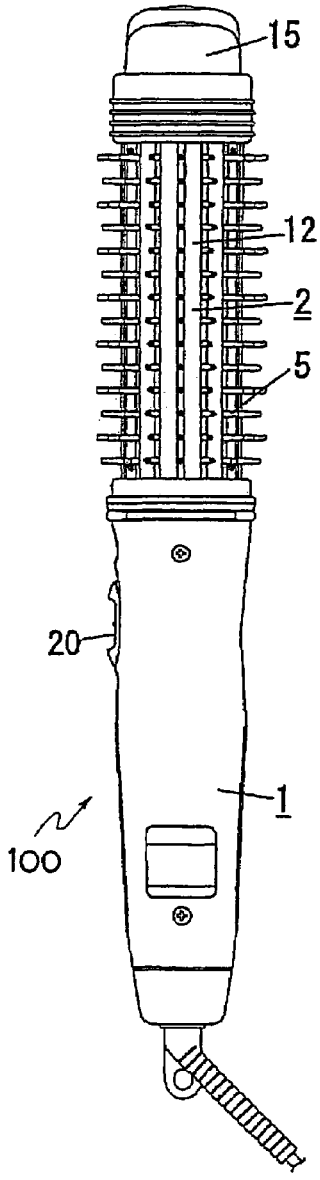

FIGS. 1 to 3C are sectional views and perspective views of a hair iron 100 according to the invention. In detail, FIG. 1 is a front sectional view of the hair iron 100, FIG. 2 is a left side view, partly in cross section, of the hair iron 100, and FIGS. 3A, 3B and 3C are front view, a right side view and a left side view of the hair iron 100.

As shown in the drawings, the hair iron 100 is formed like a bar as a whole. For example, as shown in FIGS. 3A to 3C, the hair iron 100 has a grip 1 held by a user with hand, and a hair-care section 2 for holding hair for hair care such as hair dressing. The hair-care section 2 is connected to a top end of the grip 1. The hair iron 100 is a winding type hair iron used for hair care by winding-hair with the hair-care section 2.

One of main characteristics of the hair iron 100 is that a negative ion generator to emit negative ions to hair is built in the grip 1 and that a user can operate it with a switch handle. As shown in FIG. 1, the grip 1 has a generally cylindrical housing, and the negative ion generator 4 is fixed therein.

The above-mentioned negative ions are supposed to be negatively charged substances in air bonded with a water content, for example, an ionic molecule having a negatively charged oxygen molecule bonded with water molecules. The size of a negative ion is about a few nanometers in diameter.

The addition of negative ions to hair has a following meaning. It is generally known that hair is liable to be charged positively. This becomes noticeable especially when water content in hair is evaporated because of dried hair and when hair care is performed with a brush or the like. Then, the emission of negative ions to hair is effective, firstly, for neutralization of electrostatic charges and, secondly, for permeation of water content into hair. The latter is based on that negative ions can coat the surface of hair with water due to the water content thereof and that the water content of hair can be kept high because they easily penetrate towards the back of hair due to the very small size thereof. Therefore, emission of negative ions to hair moisturizes hair to retain moisture in hair, and to have a better shape.

Negative ions generated by the negative ion generator 4 are emitted through the outlet 9 toward the user's hair. FIG. 2 shows the switch handle 20 used to operate the negative ion generator 4 (FIG. 1). The structure of the negative ion generator 4 is explained later.

It is explained here how to use the hair iron 100. A user holds hair at bristles 5 of the hair-care section 2. Then, water supplied from a water tank 15 is heated to generate steam, and the steam is ejected to the outside of the winding drum 12. The steam can moisturize hair. At the same time, the winding drum 12 is heated and the hair is heated to have a desired shape. Further, the user may operate the switch handle 20 to activate the negative ion generator 4 (FIG. 1) which emits negative ions through the outlet 9 and adheres the negative ions to hair held by the bristles 5. Thus, the damage of hair is suppressed, and hair dressing of good quality can be realized.

Next, returning to FIG. 1, the structure of the hair iron 100 is explained. First, the grip 1 is explained, and the hair-care section 2 is explained next.

The grip 1 is a part held by a user on hair dressing. The grip 1 has a switch handle 20 of slide type (FIGS. 2 and 3A to 3C) to activate the hair iron 100. The switch handle 20 controls power supply to the heater 11 and to a needle electrode 3 for the negative ion generator 4. In detail, the switch handle 20 can change a mode among off mode to deactivate the heater 11 and the negative ion generator 4 or to stop power supply, ion mode to activate the negative ion generator 4, and ion-and-iron mode to activate the heater 11 and the negative ion generator 4. Further, iron mode may be provided to activate only the heater 11. Alternatively, a heater switch for controlling power supply to the heater 11 and an ion switch for controlling power supply to the negative ion generator 4 may be provided. In these structures the emission of negative ions to hair can be performed independently of, or in parallel to the hair care using the heater 11. A user may heat hair without emitting and adhering negative ions to hair without heating hair. Thus, the hair iron can be used in various ways according to user's request.

The grip 1 has the outlet 9 for emitting negative ions from the negative ion generator 4. The outlet 9 is an opening facing a curved outer peripheral plane 7 of the winding drum 12, and its direction is inclined by 10 to 30 degrees (angle θ in FIG. 1) relative to axial line "A" of the hair-care section 2 and the grip 1. When hair is brushed with long bristles 5*a* fixed to the curved plane 7 (for example, FIG. 4), it is charged positively because of the contact with the bristles 5. Negative ions are emitted through the opening 9 and adhered to the positively charged hair. According to the above-mentioned angle of the opening 9, negative ions can adhere to the entire hair held by the hair-care section 2. Further, as will be explained later, the steam can be supplied from the curved plane 7 of the winding drum 12 towards hair (for example, FIG. 4). Because steam can penetrate deeper into hair due to negative ions, damages of hair can be prevented. Further, the result of hair dressing persists longer, and hair dressing can be performed more easily.

Figure 6:
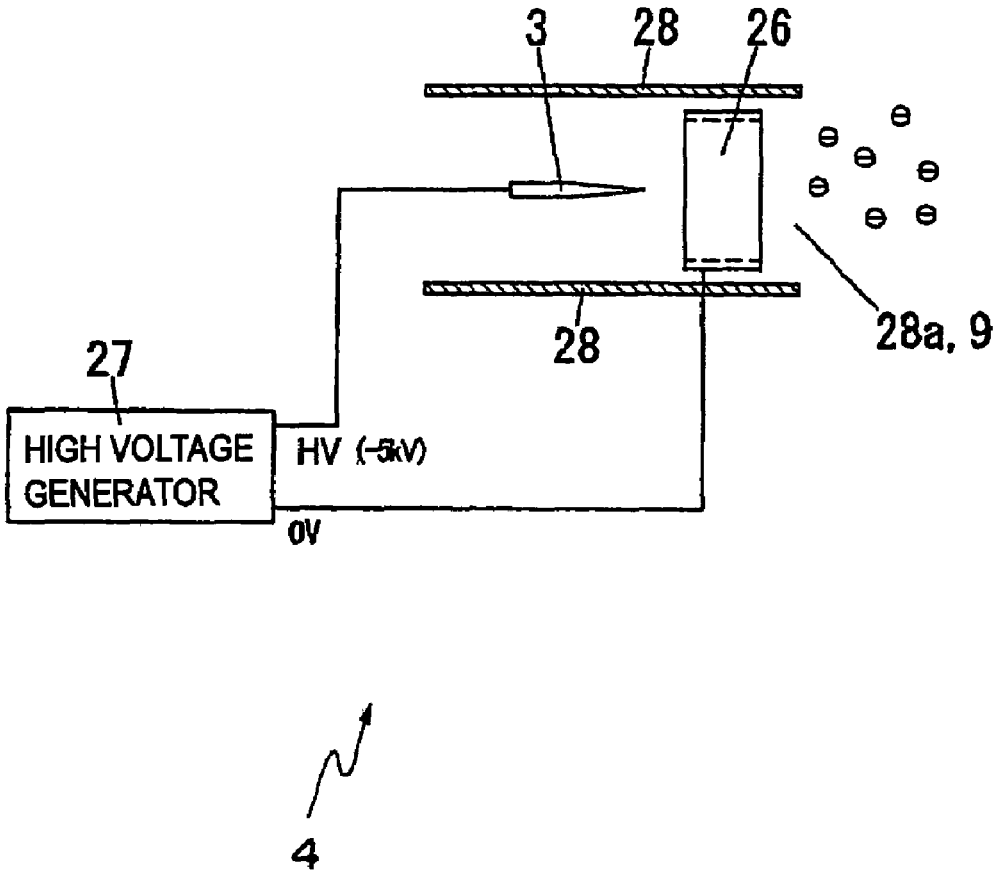
FIG. 6 is a block diagram of a structure of a negative ion generator.

FIG. 6 is a block diagram on the structure of the negative ion generator 4 having a needle electrode 3, a ground electrode 26 and a high voltage generator 27. The negative ion generator 4 generates negative ions due to discharge at the needle electrode 3. The needle electrode 3 and the ground electrode 26 are set in a case 28 made of an insulator. The case 28 is illustrated only on the top and bottom planes for the simplicity of explanation. The case 28 has an opening 28*a*. The ground electrode 26 is provided before the needle electrode 3, and the opening 28*a* is provided before the negative ground 26. The needle electrode 3 has a form of a needle fabricated by sharpening a top of a metal bar or the like. The ground electrode 28 is, for example, made of a metallic plate, and it is set before the needle electrode 3 obliquely therefrom. The negative ion generator 4 having the needle electrode 3 can concentrate electric field at the top thereof easily, so that negative ions can be generated efficiently.

In the negative ion generator 4, when DC −5 V is applied to the needle electrode 3 or a line electrode 25 relative to the ground electrode 26, corona discharge occurs around the top end of the needle electrode 3 or the line electrode 25, to generate negative ions. The generated ions are emitted along electric lines extending through the opening 28*a* of the case 28 to the external. The opening 28*a* of the case 28 plays the role of the outlet 9.

The hair iron 100 uses the negative ion generator 4. As mentioned above, the outlet 9 for emitting negative ions from the negative ion generator 4 is formed at the top of the grip 1 facing the hair-care section 2.

Figure 7A:
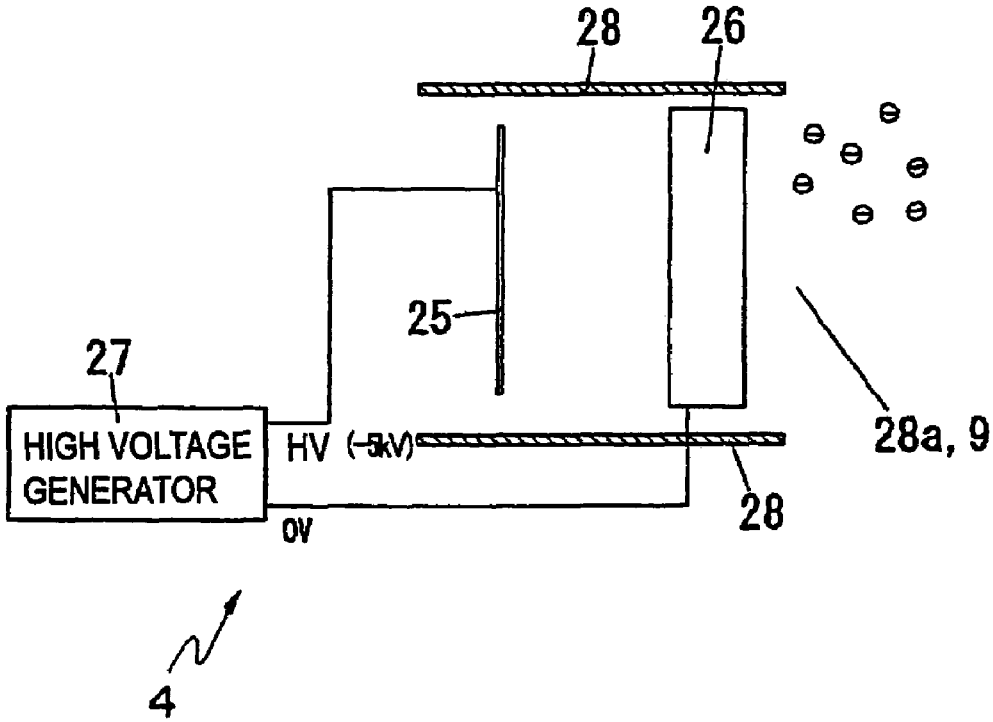
FIG. 7A is a side view of the negative ion generator.
Figure 7B:
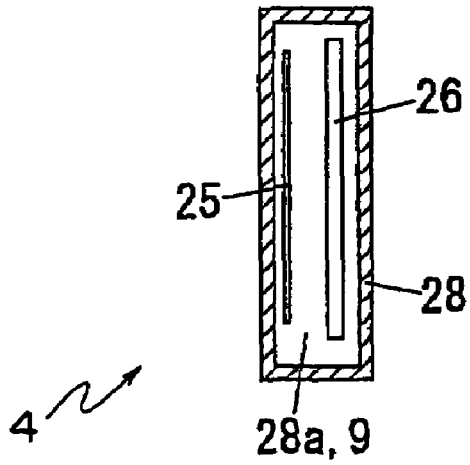
FIG. 7B is a view of the negative ion generator observed in a direction of an opening.

FIGS. 7A and 7B are block diagrams of another example of the negative ion generator 4. FIG. 7A is a side view of the negative ion generator 4. The negative ion generator 4 has the line electrode 25, the ground electrode 26 and the high voltage generator 27. The line electrode 25 and the ground electrode 26 are set in the case 28 made of an insulator. The line electrode 25 extends in an inner space of the case 28. It is to be noted that only the top and bottom planes of the case 28 are shown in FIG. 7A for the simplicity of illustration. The ground electrode 26 is provided before the electrode 3, and the opening 28*a* of the case 28 is provided before and near the ground electrode 26. FIG. 7B shows the negative ion generator 4 observed in a direction of the opening 28*a*. The line electrode 25 is, for example, a bar-like narrow conductive line. The negative ion generator 4 having the line electrode 25 has an advantage that negative ions can be generated in a wider range than the negative ion generator 4 having the needle electrode 3.

The above-mentioned negative ion generators 4 shown in FIGS. 6, 7A and 7B can generate a large amount of negative ions due to discharge t the electrode. Because a large amount of negative ions can be adhered to hair, damage of hair can be prevented, and hair dressing of good quality can be provided. Because the outlet 9 for emitting negative ions are provided near the electrode of the negative ion generator 4, the efficiency for emitting negative ions to hair held by the hair-care section 2 becomes higher. Negative ions generated around the electrode are not liable to adhere to the inner wall of the housing extending to the outlet 9, so that the as-generated negative ions can be emitted towards hair. Further, by fixing the negative ion generator 4 inside the grip 1, the hair-care section 9 has a compact structure, and the hair-care section 2 may have a various and compact shape.

Next, the hair-care section 2 is explained. Returning to FIG. 1, the hair-care section 2 has a bar-like shape connected to a top of the grip 1 along the same axial line "A" as the grip 1, and it is used for hair dressing by applying hair directly.

The hair-care section 2 mainly has a cylindrical base 10, a cylindrical winding drum 12, and a steam generator 6 at the top of the base 10. The base 10 is connected to the top of the grip 1, and it has a heater 11. The heater 11 has a heating element 11*a*, of a PCT heater which generates heat when electric power is supplied, and a heater cover 11*b* covering the heating element 11*a* and made of a metal having high thermal conductivity.

The winding drum 12 is a cylindrical member made of a metal such as aluminum having high thermal conductivity, and it is constructed as an outer peripheral plane of the hair-care section 2. The cylindrical winding drum 12 covers the base 10 and the heater 11. Many bristles 5 extrude from the outer peripheral plane of the winding drum 12. On the outer peripheral plane, grooves 13 for arranging the bristles 5 are formed as a plurality of lines from the top to the end along the longitudinal direction of the winding drum 12. A bristle member 14 to be set in a groove 13 has a bristle base 14*a* formed as a long plate and bristles 5 connected to the bristle base 14*a* so as to extrude therefrom. The bristle member 14 is inserted into the grooves 13 by sliding the bristle member 14 into the groove 13, so that the bristles 5 of the bristle member 14 extrude from the outer peripheral plane of the winding drum 12. As to the groove 13 in which the bristle base 14*a* is set, the width of a longitudinal opening of the groove 13 at the outer peripheral plane of the winding drum 12 is smaller than that of the bristle base 14*a*, and this prevents that the bristle member 14 falls to the outside. The inner peripheral plane of the winding drum 12 contacts with an outer peripheral plane of the heater cover 11*b*, so that the winding drum 12 is warmed by heat conduction from the heater cover 11*b* and radiates heat. A user contacts hair to the winding drum 12 in order to use the heat for hair dressing.

In the steam generator 6, water in the water tank 15 is taken out from a water supplier 15*a* thereof, and the supplied water in contact with the heater cover 11*b* of the heater 11 is evaporated to generate steam. In concrete, the steam generator 6 arranges the water tank 15 at the top end of the base 10, and the water tank 15 is movable in the direction of the top to base ends. A spring 17 is provided between the top end of the heater cover 11*b* and the base end of the water tank 15, and a water supply 15*a* including felt for absorbing water is provided at the base end of the water tank 15. Further, a protrusion 16 for pressing felt is arranged at the top end of the heater cover 11*b*.

When a user pushes the water tank 15 against the force of the spring 17 with hand, the felt as the water supply 15*a* is pressed to the protrusion 16, so as to squeeze water absorbed in the felt. Thus, water contacts with the heater cover 11*a* and evaporates to generate steam. On the inner peripheral plane of the winding drum 12, grooves 18 are formed as passages for steam, and they are over the direction of the top to base end by slightly extending to the outside. The grooves 18 are operated as passages between the inner plane of the winding drum 12 and the heater cover 11*b*, and they are connected to the grooves 13 for bristles and to the steam generator 6 on the base 10. That is, the grooves 18 can be used as passages guiding the steam generated by the steam generator 6 to the grooves 13 for bristles. The steam arriving to the grooves 13 is ejected through injection portions such as spaces 19 between the bristle members 14 and the grooves 13 or injection holes (not shown) penetrating through the bristle base 14*a* of the bristle members 14, towards the outside of the winding drum 12. Therefore, hair can be straitened efficiently by applying steam while brushing hair.

Figure 4:
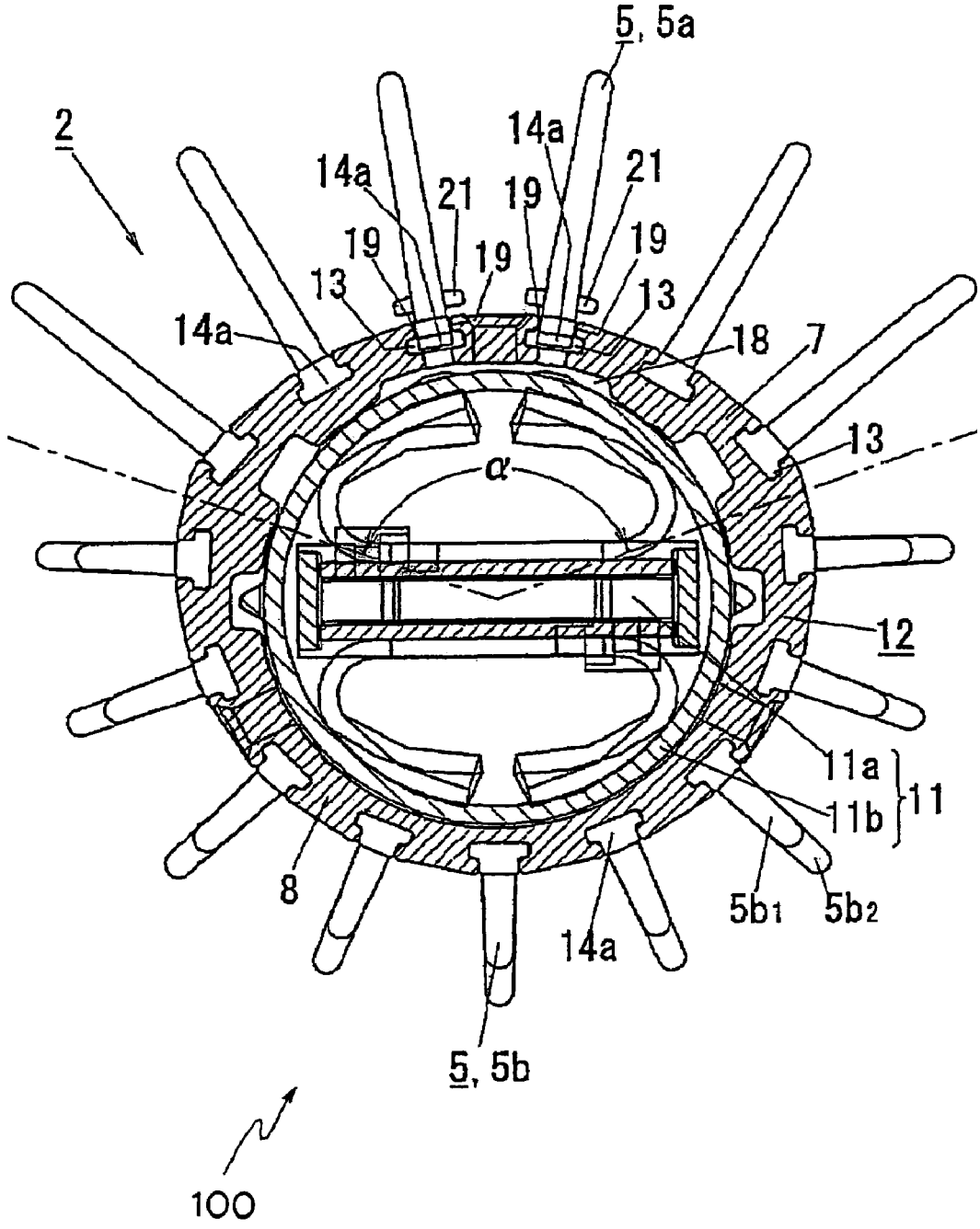
FIG. 4 is a sectional view of a winding drum.

FIG. 4 is a sectional view of the winding drum 12. The winding drum 12 has an elliptic cross section having a curved plane 7 of a larger curvature of radius and another curved plane 8 of a smaller curvature of radius, fabricated for example with extrusion or the like. The bristles 5 include two types of bristles, that is, long bristles 5*a* and short bristles 5*b*. The long bristles 5*a* are fixed to the curved plane 7 of a larger curvature of radius, while the short bristles 5*b* are fixed to the curved plane 8 of a larger curvature of radius. By providing the long bristles 5*a* in the first curved plane 7, brushing becomes easier, for example, to make or adjust hair straightly. By providing the short bristles 5*b* in the second curved plane 8, it becomes easier, for example, to wind hair around the hair-care section 2 or to curl hair by adjusting hair flow.

Further, as mentioned above, the hair iron 100 has long bristles on the first curved plane 7 and short bristles on the second curved plane 8 of the winding drum 12. Then, it has two functions of straight ironing for straightening hair and curl ironing for curling hair simultaneously. Further, the short bristles 5*b* have very short bristles 5*b*1 and relatively short bristles 5*b* arranged alternately, in order to improve the winding effect of the short bristles 5*b*.

The curved plane 7 extends in a range between 90 and 120 degrees around the axial line of the bar-like winding drum 12 (or a range of ⅓ to ¼ of the outer plane). This is shown as an angle α in FIG. 4. Thus, the shape of bar-like hair-care section 2 is deformed to a degree so as not to disturb hair winding, while a position for brushing can be reserved in a wide range of the hair-care section 2. Thus, hair can be brushed effectively, and a user can use the hair iron easily.

In the bristle base 14*a* of the hair iron, the width of the portion from which the bristles 5 extrude is narrower than the other portion. Thus, space 19 is provided positively between the groove 13 and the bristle base 14*a* at the base of the bristle 5. The space 19 is an ejection portion for ejecting steam and the steam is ejected from the base of the bristle 5. Further, in the hair iron 100, a ring 21 is given near a base of the bristle 5 to diffuse the ejected steam. The ring 21 is a plate extending around the periphery of the bristle 5 and perpendicularly to the protruding direction of the bristle 5. By using the rings 21, a large quantity of steam can be generated by the steam generator 6. Thus, hair which would be dried by the heating of the winding drum 12 can be moisturized efficiently, hair damage can be prevented, and the effect of hair dressing will persist longer.

Figure 5:
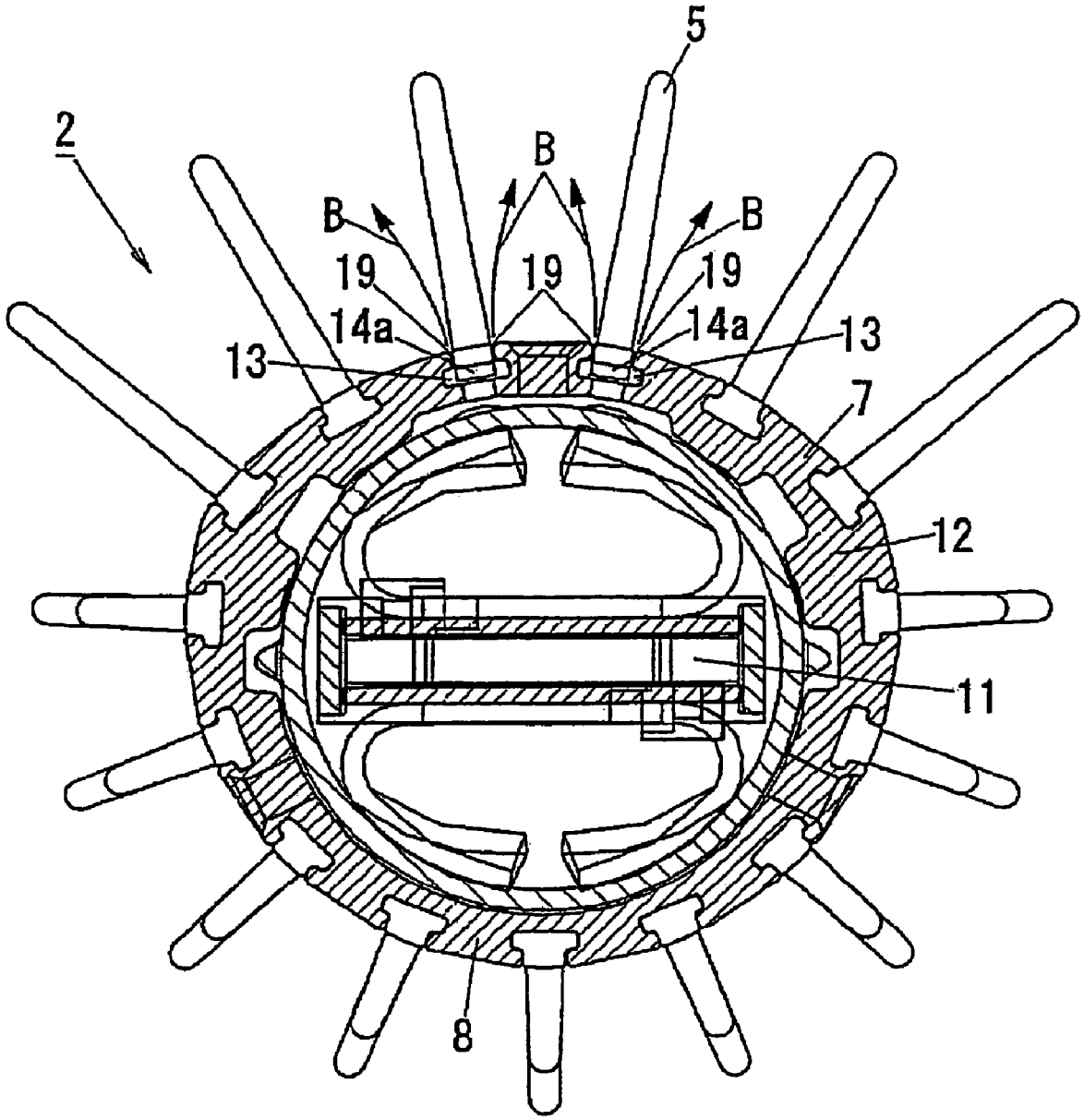
FIG. 5 is a sectional view of the winding drum without a ring.

Further, FIG. 5 is a sectional view of the winding drum 12 having no ring 21. When rings are not used, if a large quantity of steam is generated by the steam generator 6, hair may be heated excessively by the steam (arrow B) or scalp may be burned due to the steam. Therefore, because of safety, the steam of a small quantity has to be used. Then, a sufficient quantity of water cannot be given to hair and hair is liable to be damaged by drying, or the effect of hair dressing will not persist long.

On the other hand, in the hair iron 100 having the rings 21 shown in FIG. 4, steam of a large quantity ejected towards the base of the bristles 5 can be diffused by the rings 21. Therefore, even if steam of a large quantity is generated, hair will not be heated excessively or the scalp will not be burnt by the steam. By using steam of a large quantity, the hair which is liable to be dried by heating by the winding drum 12 can be moisturized effectively, so that hair damage can be prevented, and the effect of hair dressing will persist longer.

Figure 8:
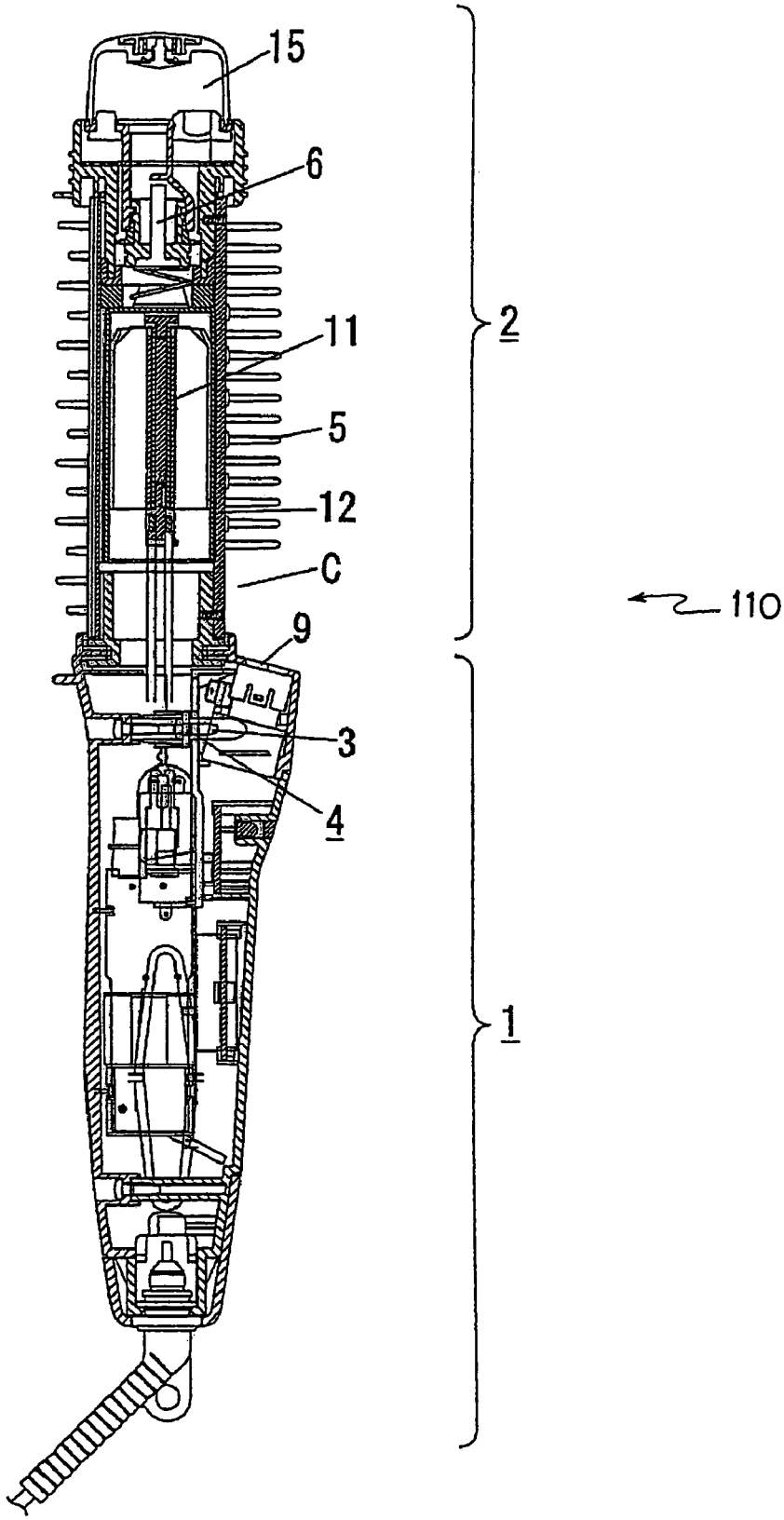
FIG. 8 is a front sectional view of a hair iron of a first embodiment.

FIG. 8 is a front sectional view of a hair iron 110 of a first modified embodiment. The hair iron 110 is different from the hair iron 100 (FIG. 1) in a point that bristles 5 around a position C near an outlet 9 are removed among the bristles provided on an outer peripheral plane of the hair-care section 2. In other words, the bristles 5 are positioned separately by distances more than a predetermined distance (for example, 2 to 3 centimeters) from the position C near the outlet 9. The reason is explained here. If the bristles 5 exist near the position C, they are exposed to negative ions for a long time to be charged negatively, so that negative ions which will pass between the bristles 5 are repelled or blown away. Therefore, the amount of negative ions which would arrive to hair is liable to be decreased. Then, bristles 5 near the position C are removed so as to emit negative ions efficiently towards the entire hair. The hair iron 110 is similar to the above-mentioned hair iron 100 (FIG. 1) except the above-mentioned point, and detailed explanation thereof is omitted here.

In the above-mentioned modified embodiment, the bristles 5 near the position C are removed. Alternatively, the bristles 5 near the outlet 9 among the bristles 5 on the outer surface of the hair-care section 2 are formed to have a shorter length. Thus, negative ions can be emitted efficiently towards the entire hair.

The hair iron 110 shown in FIG. 8 is used to wind hair around the hair-care section 2 to curl hair. However, it may be another type of an instrument wherein hair is held between two parts in order to straighten hair. It is to be noted that because the negative ion generator 4 is built in the grip 1, the shape of the hair-care section 2 has high degree of freedom so that various types of instruments can be realized.

Figure 9:
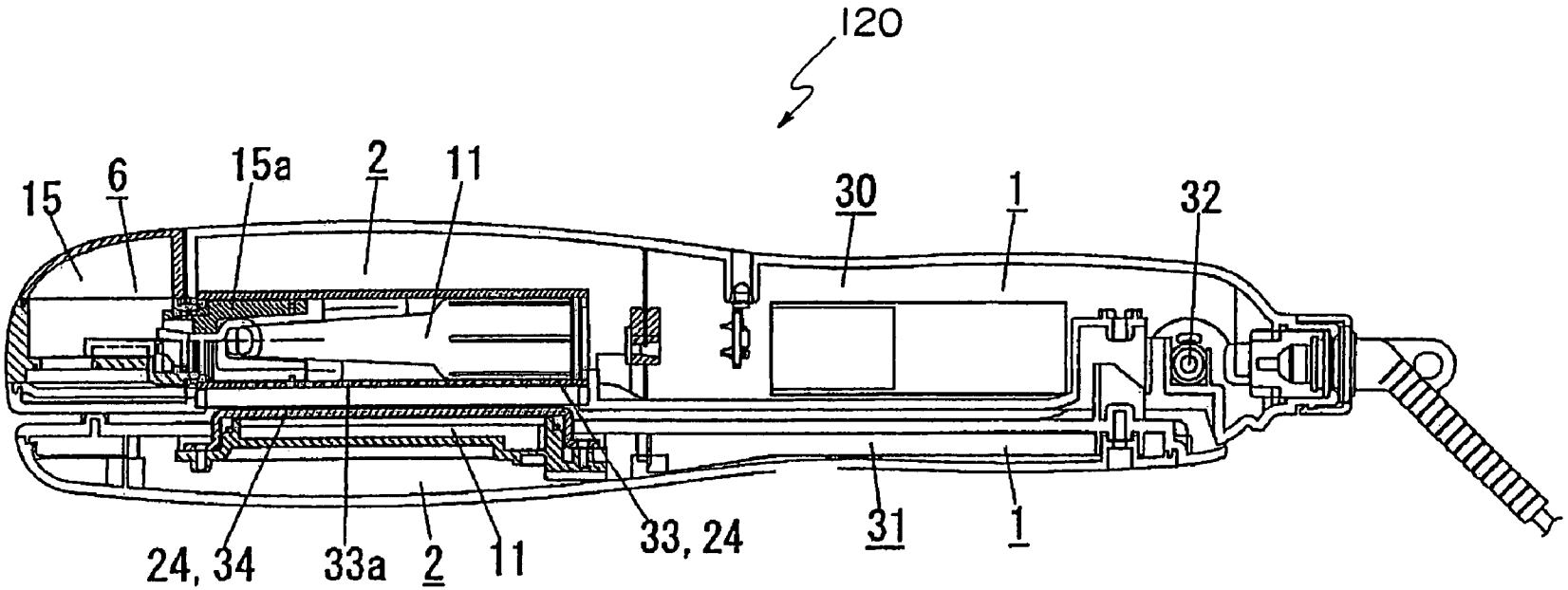
FIG. 9 is a front sectional view of a hair iron of a second embodiment.

Next, a hair iron of a second embodiment of the invention is explained with reference to FIGS. 9 to 13B. FIG. 9 is a front sectional view of a hair iron 120 of the second embodiment. The hair iron 120 is an instrument of a type where hair is held between heating planes for hair dressing or the like. The hair iron 120 has a main block 30 and a presser foot block 31 both having a semicircular cross section. They are combined at an axis 32 at one end of the hair iron 120 while they are opened or closed at the other end. A grip 1 is provided around the axis 32 for the main block 30 and the presser foot block 31 for a user to support the hair iron 120. On the other hand, a hair-care section 2 is provided for a user to open and close the main block 30 and the presser foot block 31. The holding planes 24 of the main block 30 and the presser foot block 31 in the hair care section 2 are also used as heating planes when heated by a heater 11. Hair is interposed between the hair-care section 2 of the main block 30 and that of the presser foot block 31, and hair dressing is possible by using heat at the heating planes. As shown in FIG. 8 clearly, the main block 30 and the presser foot block 31 are formed linearly as parts of the grip 1 and of the hair-care section 2. Further, the hair iron 120 has the above-mentioned negative ion generator (not shown) inside the main block 30.

Components in the hair iron 120 are explained below. The main block 30 has the grip 1 to be held by a user on hair dressing, and the hair-care section 2 for hair dressing for the user's hair. The grip 1 has the axis 32. The hair-care section 2 has a heater 11 and a steam generator 6, and it has also an iron plate 33 on the holding plane 24 to be operated with the presser foot block 31. The heater 11 heats the water supplied from the water tank 15 in the steam generator 6 to generate steam. Thus, the iron plate 33 or the holding plane of the main block 30 becomes the heating plane when heated by the heater 11. Further, steam is ejected from many throughholes 33*a* in the iron plate 33 towards the outside. The water tank 15 is detachable to the main block 30. The water supply from the water tank 15 to the heater 11 is performed by a water supplier 15*a* made of a water-absorbing material such as felt provided at an end of the water tank 15. An end of the water supplier 15*a* which absorbs water is connected to the heater 11, so that water in the water supplier 15*a* in contact with the heater 11 is heated by the heater 11 to be evaporated as steam.

On the other hand, the presser foot block 31 has the axis 32 in the grip 1, the heater 11 in the hair-care section 2 and the holding plate 34 of the holding plane 24 to be operated with the main block 30. The heater 11 heats the holding plate 34. That is, the holding plate 34 as the holding plane on the side of the presser foot block 31 becomes the heating plane when heated by the heater 11.

The shapes of the iron plate 33 and the holding plate 34 of the holding planes 24 determine the types of hair reforming when hair is held between the holding planes 24. For example, FIGS. 10A to 10D show an example where the iron plate 33 and the holding plate 34 are planer. Thus, hair can be straightened. On the other hand, FIGS. 11A to 11D show an example where the iron plate 33 and the holding plate 34 are wavy in cross section. Thus, hair can be reformed like a wave.

Returning to FIG. 9, it is explained how to use the hair iron 120. A user holds hair between the holding planes 24 in the hair-care section 2. For example, a direction along which hair is straightened is set perpendicularly to the longitudinal direction of the hair iron 120, and hair is held between the holding planes 24. Then, the hair iron 120 is slid toward the end of the hair. Thus, hair introduced into the holding planes 24 is heated from the base to the end thereof, so that it is subjected to reforming. At the same time water content is supplied with the steam for the hair introduced into the hair-care section 2. By using the hair iron 120 in this way, a user can perform hair care such as hair dressing continuously.

Further, as explained above on the hair iron 100 (FIG. 1), the negative ion generator 4 which generates negative ions by discharge is built in the hair-care section 2 of the main block 30. FIGS. 10A to 10D are sectional views of the hair iron 120 of a type having holding planes 24 planar in cross section, while FIGS. 11A to 11D are sectional views of the hair iron 120 of a type having holding planes 24 wavy in cross section. The negative ion generator 4 is shown explicitly in these drawings. It may be the negative ion generator having the needle electrode 3 shown in FIG. 6 or the negative ion generator having the line electrode 25 shown in FIG. 7.

Negative ions generated by the negative ion generator 4 are emitted through the outlet 9. By adjusting the position of the outlet 9 in the hair iron 120, many negative ions can be adhered efficiently to the hair held by the hair-care section 2, and this prevents damage to hair-when hair care such as hair dressing is performed with the hair-care section 2.

In FIGS. 10A, 10B, 11A and 11B, the outlet 9 is formed at a side of the hair-care section 2 in a direction in which the hair passing the hair-care section 2 extends. In concrete, the outlet 9 is formed near a side of the iron plate 33 as the holding plane 22 of the hair-care section 2 of the main block 30. By arranging the outlet 9 in this way, negative ions can be emitted to hair just before introducing the hair to the hair-care section 2 or just after the hair goes out from the hair-care section 2. Thus, on hair care such as hair dressing in the hair care section 2, hair damage can be prevented or the damage can be cared, so that good and efficient hair dressing become possible.

Figure 10A:
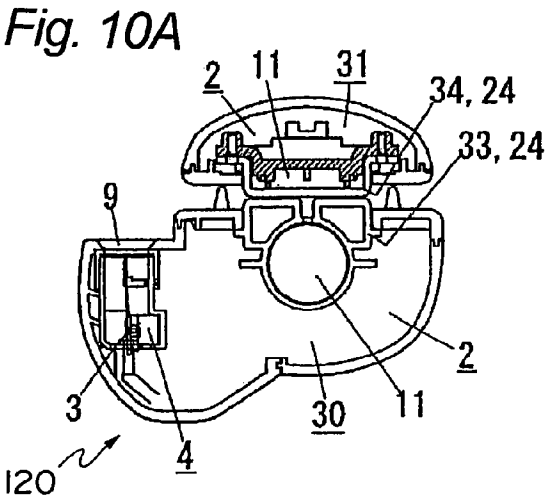
FIGS. 10A to 10D are sectional views of a hair iron of a type having a holding plane with cross section of a flat plane.
Figure 10B:
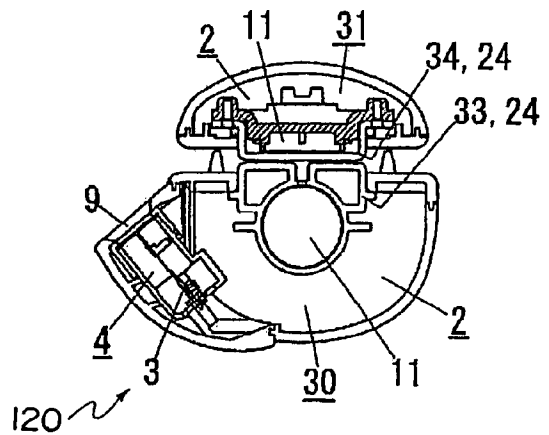
Figure 11C:
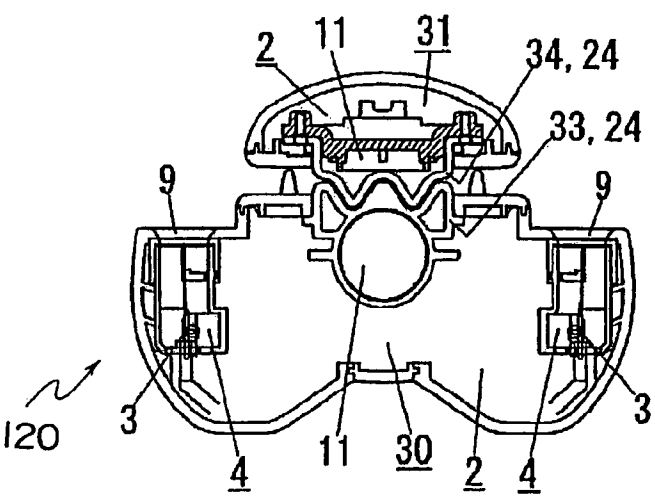
FIGS. 11A to 11D are sectional views of a hair iron of a type having a holding plane with cross section of a wavy plane.
Figure 11D:
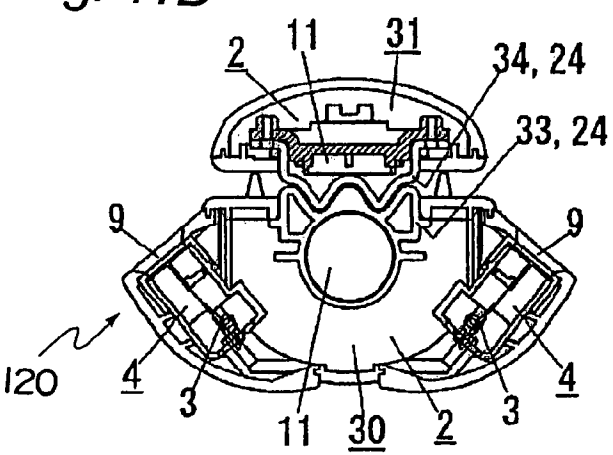
Figure 11A:
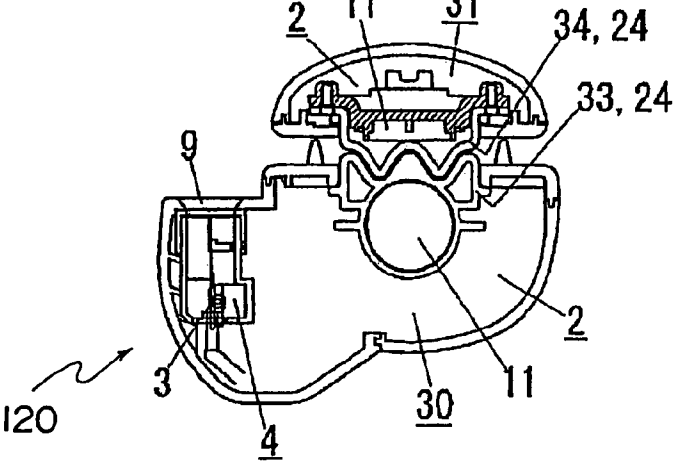
Figure 11B:
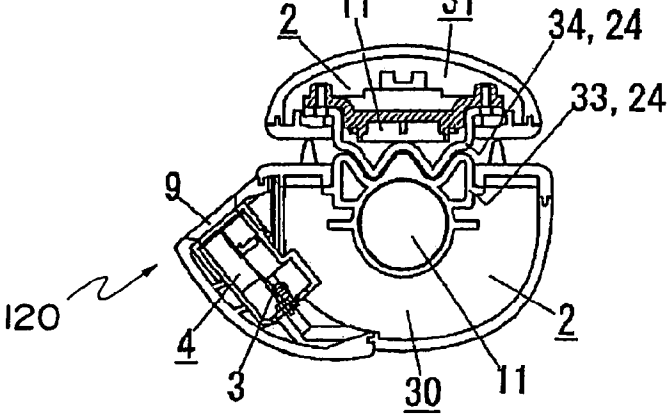

In FIGS. 10A and 11A, the outlet 9 has an opening in a direction in which the emitted negative ions cross the holding planes 24. That is, the outlet 9 is in parallel to a plane including the left and right sides of the iron plate 33. Thus, negative ions are emitted perpendicularly to the hair passing the hair-care section 2 to apply and adhere them strongly to hair. Thus, efficiency to adhere negative ions to hair is improved. Further, in FIGS. 10B and 11B, the outlet 9 is opened in a direction away from the hair-care section 2 (or holding plane 24). Thus, negative ions emitted from the outlet 9 can be applied and adhered in a wide range of hair. Therefore, efficiency to adhere negative ions to hair is improved also in this case.

Further, in FIGS. 10C, 10D, 11C and 11D, the outlets 9 are opened at two sides of the hair-care section 2, in a direction perpendicular to the longitudinal direction (extending direction of hair passing the hair-care section 2). In concrete, the outlets 9 are opened around sides of the main block 30 along a direction perpendicular to the longitudinal direction thereof. By arranging the outlets 9 in the two sides of the hair-care section 2 in the same direction as the extending direction of hair introduced into the hair-care section 2, negative ions can be applied and adhered surely for hair just before passing the hair-care section 2 and for hair just after passing the hair-care section 2. Thus, on hair care such as hair dressing in the hair care section 2, hair damage can be prevented or the damage can be cared, so that good and efficient hair dressing become possible. It is to be noted that negative ions are liable to vanish when heated. However, in the structures of FIGS. 10C, 10D, 11C and 11D, even if negative ions vanish by heating, negative ions can be added surely for hair after hair care such as hair dressing, and an effect of negative ions to hair would remain long.

Figure 10C:
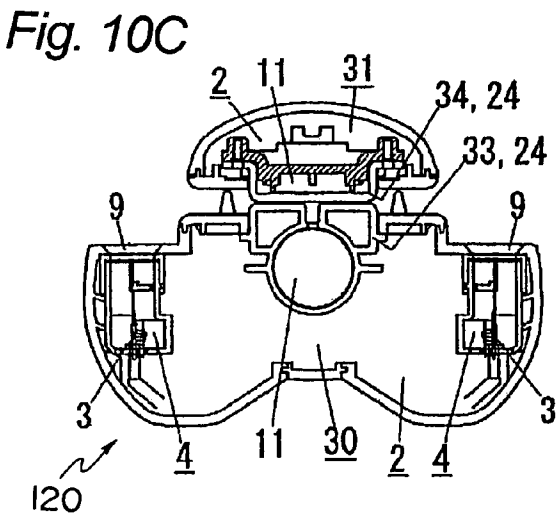
Figure 10D:
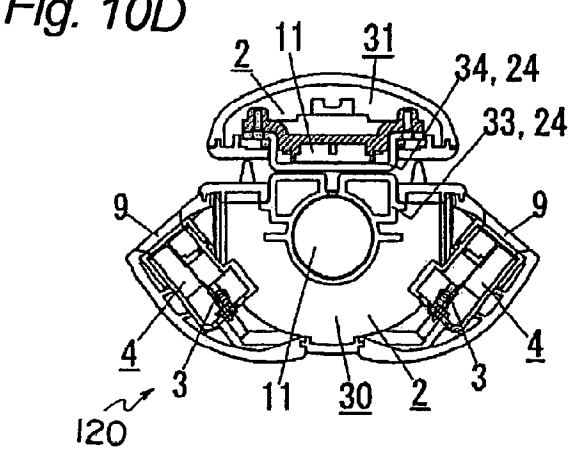

In FIGS. 10C and 11C, the outlet 9 opens in a direction in which emitted negative ions cross perpendicularly to the holding plane 24. Therefore, negative ions emitted from the outlet 9 can be applied to hair strongly, so that the efficiency to adhere negative ions to hair is improved. On the other hand, in FIGS. 10D and 11D, the outlet 9 opens away from the hare-care section 2 (or holding plane 24) or towards the outside. Thus, negative ions emitted from the outlet 9 can be applied and adhered in a wide range of hair. Therefore, efficiency to adhere negative ions to hair is improved also in this case.

Figure 12A:
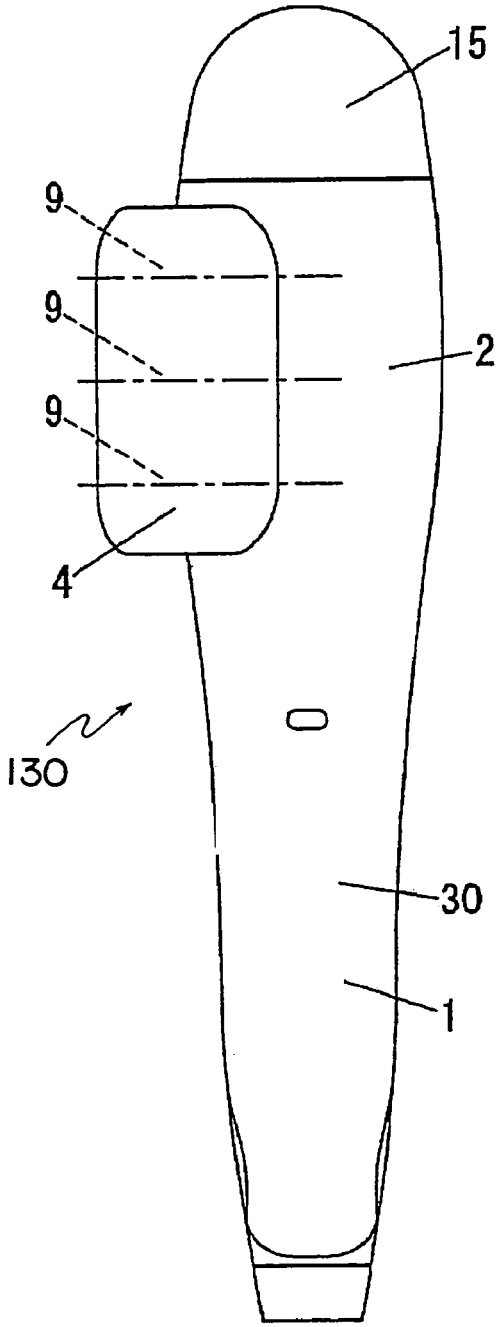
FIG. 12A is a front view of a hair iron having outlets provided at a side thereof.
Figure 12B:
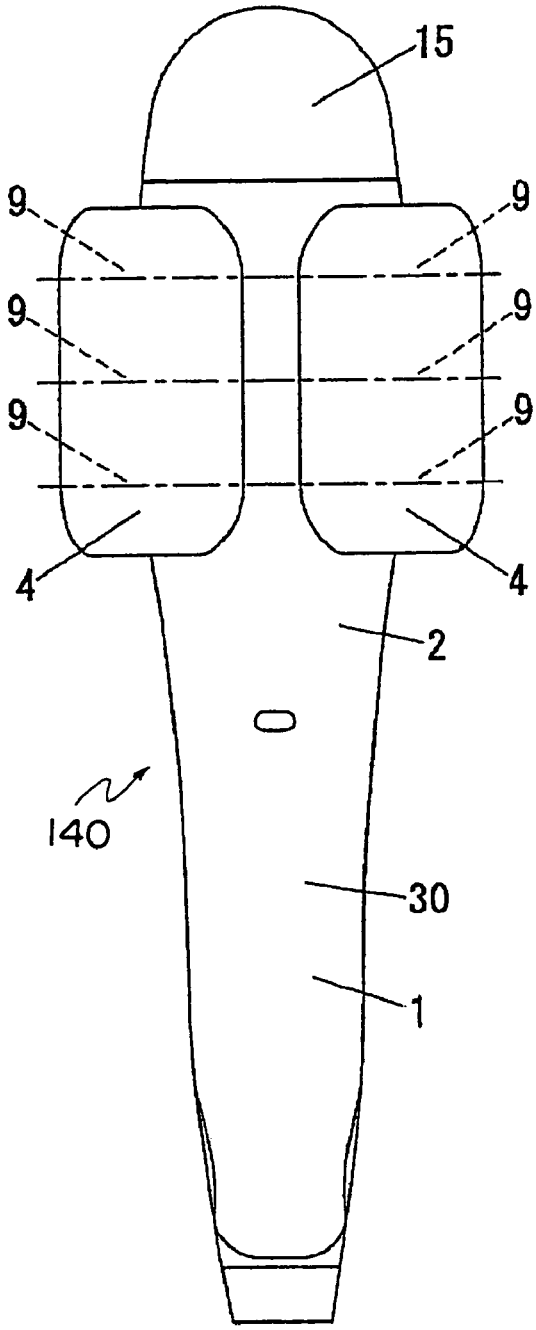
FIG. 12B is a front view of a hair iron having two outlets provided at two sides thereof.
Figure 13A:
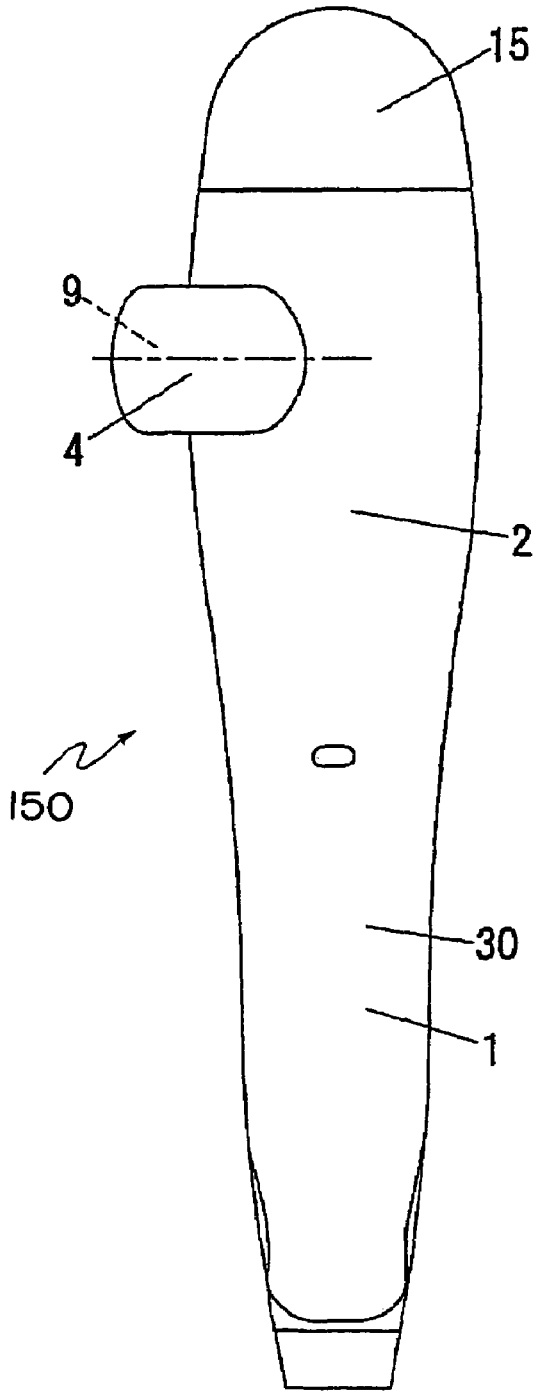
FIG. 13A is a front view of a hair iron having an outlet provided at a side thereof.
Figure 13B:
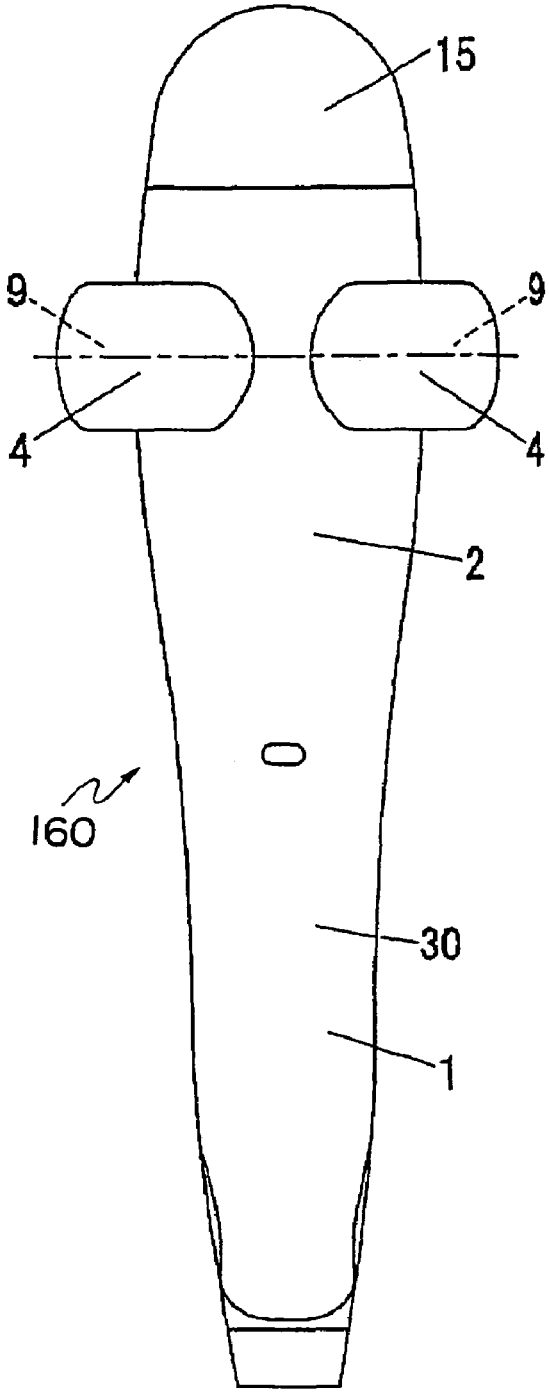
FIG. 13B is a front view of a hair iron having two outlets provided at two sides thereof.

The hair irons having the cross sections shown in FIGS. 10A to 10D and 11A to 11D may be embodied, for example, as shown in FIGS. 12A and 12B or in FIGS. 13A and 13B.

FIG. 12A is a front view of a hair iron 130 having a plurality of outlets at a side thereof, and FIG. 12B is a front view of a hair iron 140 having a plurality of outlets at each of the two sides thereof. By providing the plurality of outlets 9, negative ions can be applied to hair in a wider range, and the efficiency of adhering negative ions to hair is improved further. Further, in the case of the hair iron 140, negative ions can be emitted surely to hair before and after passing the hair-care section 2.

On the other hand, FIG. 13A is a front view of a hair iron 150 having an outlet 9 at a side of the hair-care section 2, and FIG. 13B is a front view of a hair iron 160 having an outlet 9 at each of two sides of the hair-care section 2. The hair iron 150 or 160 has the above-mentioned advantage explained above with reference to FIGS. 10A to 10D and FIGS. 11A to 11D. If they are compared with the hair iron of FIGS. 12A and 12B, their structures are simper and more compact and has a lower cost because the number of the outlet 9 is small.

In instruments such as the hair iron 130 shown in FIG. 12A and the hair iron 140 shown in FIG. 12B wherein negative ions can be applied to hair in a wide range, it is preferable to use the negative ion generator 4 having the line electrode 25 shown in FIG. 7, because the negative ion generator 4 itself can generate negative ions in a wide range. By using this negative ion generator 4, it is possible to simplify the structure of the hair iron. As to the shape of the outlet 9, it is preferable to be opened long along the side end in the left and right direction of the iron plate 33.

In the second modified embodiment, the structure of the hair iron is similar to that of the above-mentioned one explained with reference to FIG. 1 and the like, except the above-mentioned characteristics. Therefore, in the hair irons 120, 130 and 140, the grip has the switch handle of slide type. Therefore, emission of negative ions to hair can be performed independently of or in parallel to the hair care using the heater 11, or negative ions can be adhered without heating hair. Thus, the effect of negative ions to hair can be enjoyed selectively, and a use can use the hair iron in various ways.

Figure 14:
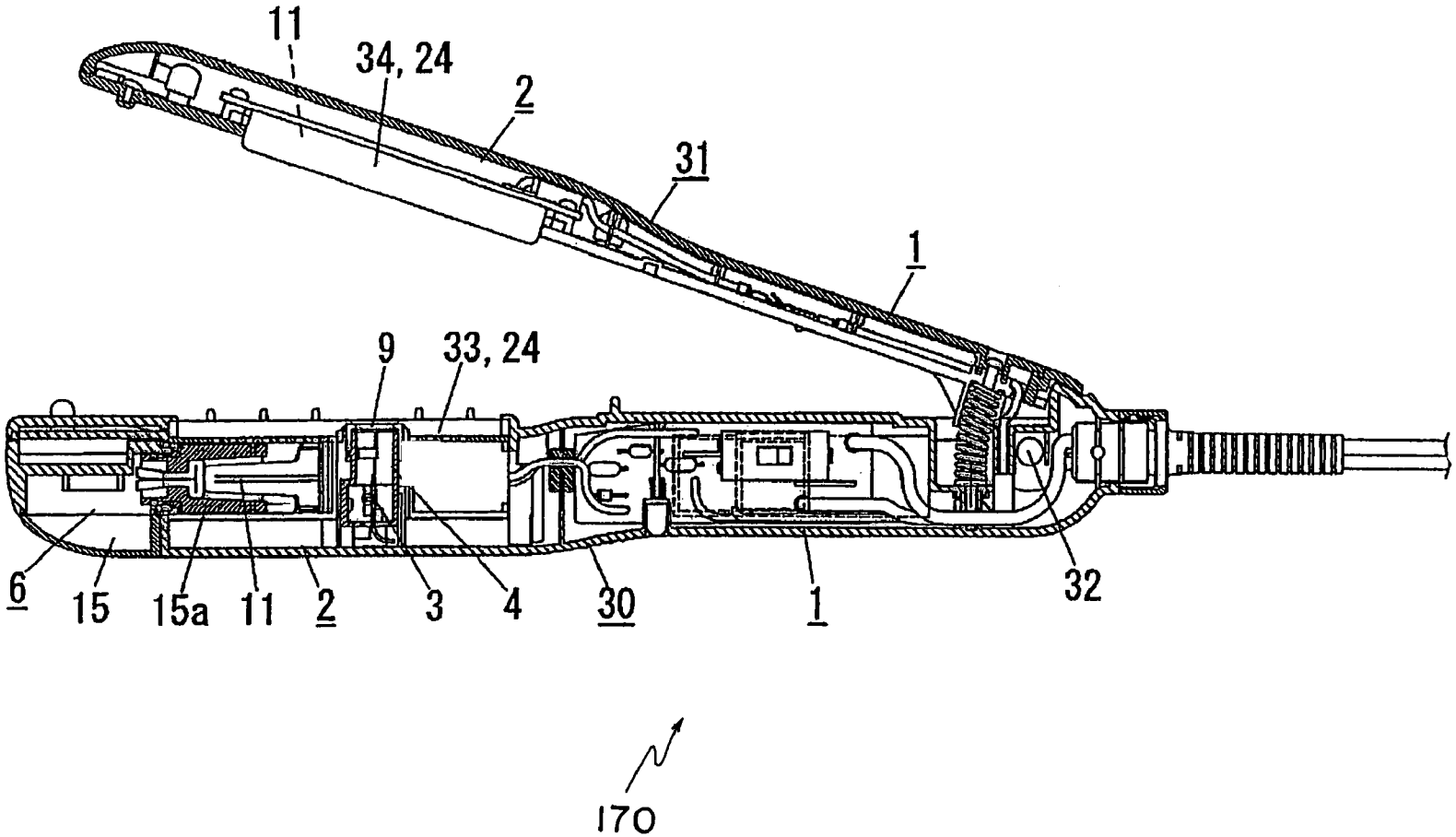
FIG. 14 is a front sectional view of a hair iron of a third embodiment.

FIG. 14 is a front sectional view of a hair iron 170 of a third modified embodiment. The hair iron 170 is obtained by modifying the hair iron of the second modified embodiment (FIGS. 9 to 13). A difference of the hair iron 170 from the second modified embodiment is that an outlet 9 is provided in an iron plate 33 as a holding plane 24. In the structure, negative ions can be emitted perpendicularly to the hair held by the hair-care section 2 and from a very short distance. That is, negative ions can be emitted and adhered strongly to hair. Therefore, the efficiency of adding negative ions to hair is improved further. Further, a plurality of outlets 9 may be provided in the iron plate. Similarly to the structures of FIGS. 12A and 12B, a plurality of outlets 9 may be provided in the iron plate in the longitudinal direction of the iron plate 33. By using a plurality of outlets 9, negative ions can be applied and adhered to a wide range of hair. The other structure of the hair iron 170 is similar to that of the hair iron of the second modified embodiment, and its explanation is omitted here.

Figure 15B:
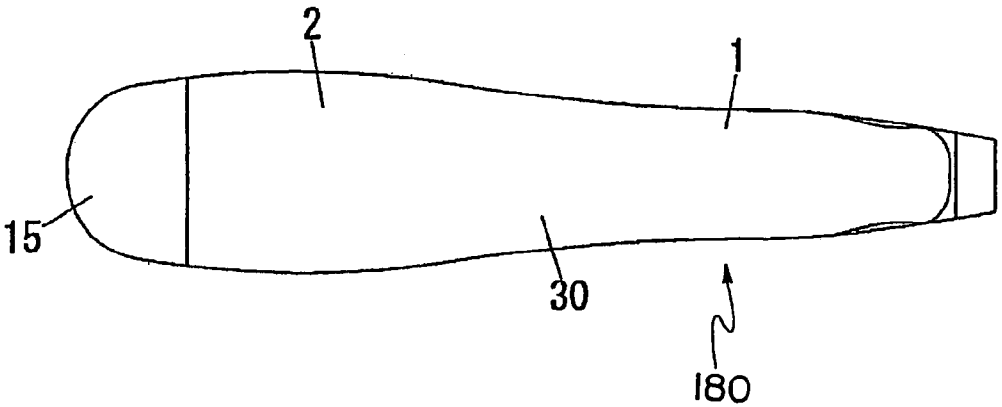
FIGS. 15A, 15B and 15C are a front sectional view, a front view and a vertical sectional view of a hair iron according to a fourth embodiment.
Figure 15A:
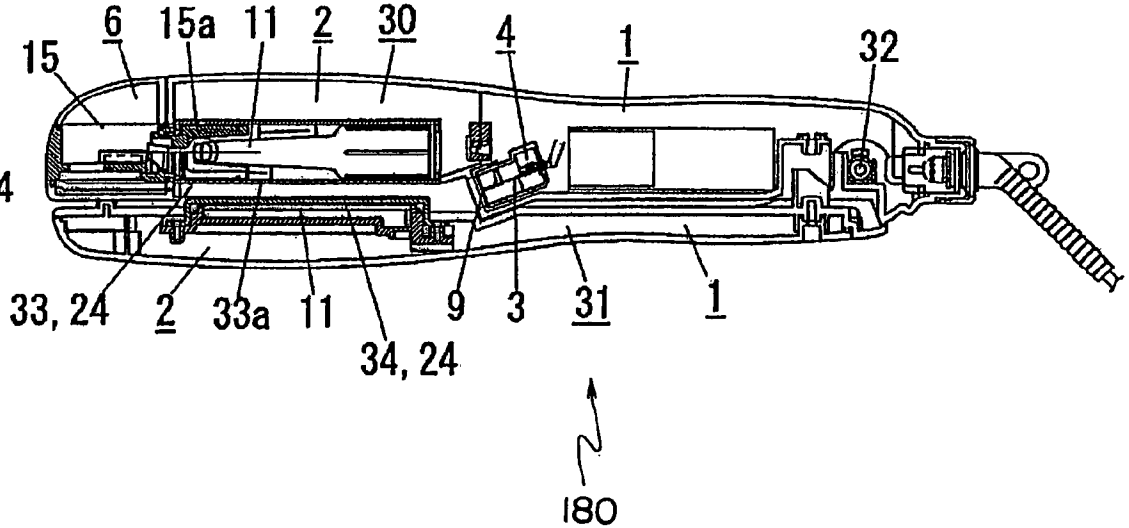
Figure 15C:
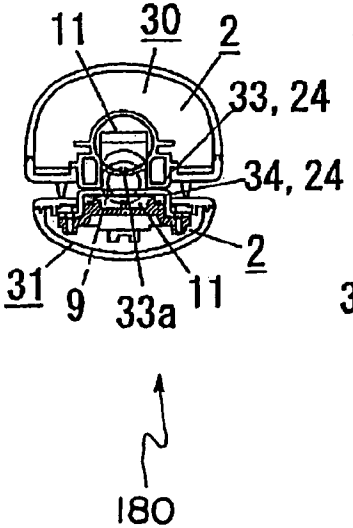
Figure 16:
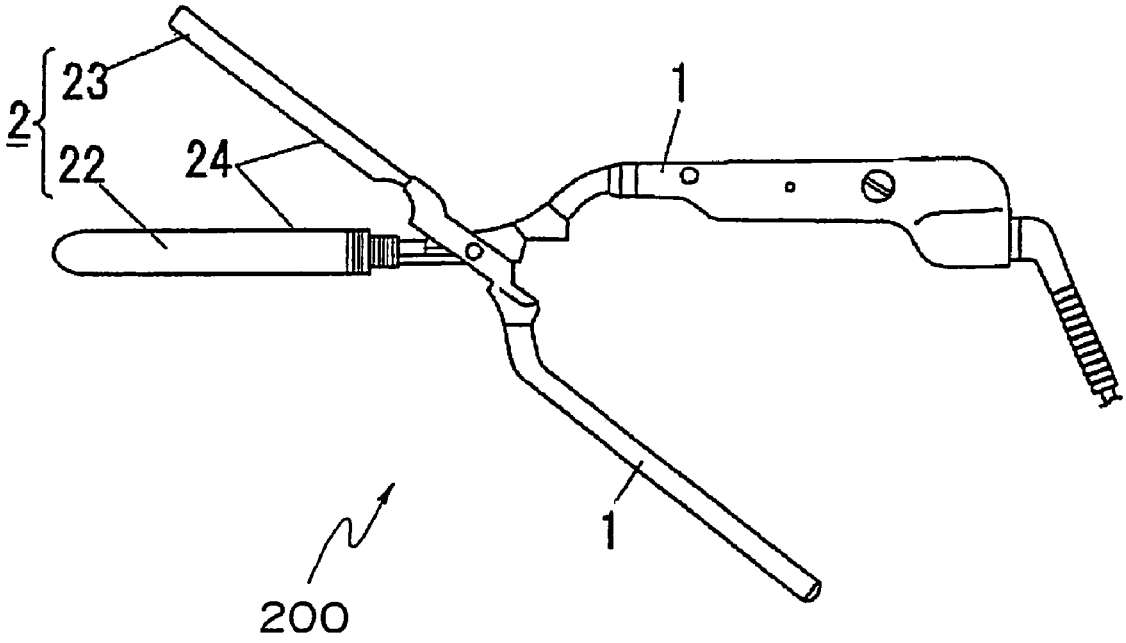
FIG. 16 is a perspective view of a prior art electric iron for hair dressing.

FIGS. 15A, 15B and 15C are a front sectional view, a front view and a vertical sectional view of a hair iron 180 according to a fourth modified embodiment. The hair iron 180 is also a modified embodiment of the above-mentioned holding-type hair iron. A difference thereof from the above-mentioned holding-type hair iron is that a negative ion generator 4 is built in the grip 1 of the main block 30 and that an outlet 9 emitting negative ions opens towards the hair-care section 2 for holding hair. In particular, the negative ion generator 4 is built in the grip 1 in a position near the hair-care section 2. Further, the outlet 9 is provided between the grip 1 and the hair-care section 2, and it faces the presser foot plate 34 of the presser foot block 31. By setting the negative ion generator 4 in the grip 1, the hair-care section 2 can be made compact and with a light weight. Therefore, the hair iron can fabricated to have a various shape, a compact size and a light weight, and this makes it easier for a user to handle the hair iron. Further, because the outlet 9 is opened towards the hair-care section 2, negative ions can be emitted and adhered to hair on hair dressing.

In the above-mentioned hair irons of holding type, the main block 30 and the presser foot block 31 both having a semicircular cross section are supported at an axis at an end opposite to the hair-care section 2. However, the invention can be applied to a hair iron where the grip and the hair-care section are connected to each other like a bar while the presser foot block of the main and presser foot blocks are connected to each other like a form of paddle. In this case, the axis may be positioned near a connecting portion to support the main block and the pressing foot block, near a connection portion between the grip and the hair-care section of the main block and the pressing foot block 31.

The invention claimed is:

1. A hair iron comprising:

a grip;

a hair-care section connected to the grip, the hair-care section having a hair holding section and a heater that generates heat to hair for hair dressing;

a negative ion generator provided outside the hair-care section, to generate negative ions due to discharge around an electrode therein and to emit the negative ions toward the hair disposed outside the hair care-section;

a plurality of bristles provided on an outer surface of the hair-care section;

a steam generator having a movable water tank provided to an end of the hair-care section opposite the grip; and a ring which diffuses the steam generated by the steam generator, the ring being provided on the plurality of bristles;

at least one outlet that emits negative ions at a position where the hair crosses the hair holding section.

2. The hair iron according to claim 1, further comprising an outlet near the electrode to emit the negative ions therethrough.

3. The hair iron according to claim 1, wherein the hair-care section has a bar-like shape, and the heater is fixed to an outer surface of the bar-like shape.

4. The hair iron according to claim 3, wherein the negative-ion generator is built in the grip, and the grip further comprises an outlet opening to the hair-care section to emit the negative ions towards the hair-care section.

5. The hair iron according to claim 3, wherein the outer surface of the hair-care section comprises a first curved surface having a first curvature of radius and a second curved surface having a second curvature of radius smaller than the first curvature of radius, the bristles comprising bristles having a first height in the first curved surface and bristles having a second height lower than the first height in the second curved surface.

6. The hair iron according to claim 5, wherein the first curved surface occupies a portion in the outer peripheral plane in correspondence to a range between 90 and 120 degrees around the axial line of the hair-care section.

7. The hair iron according to claim 5, further comprising an ejector which ejects the steam generated by the steam generator.

8. The hair iron according to claim 1, further comprising a switch that selectively operates the heater at the hair-care section and the negative ion generator.

9. A hair iron comprising:

a grip;

a hair-care section connected to the grip, having a hair holding section and a heater that generates heat to hair for hair dressing;

a negative ion generator which generates negative ions due to discharge around an electrode therein;

a plurality of bristles provided on an outer surface of the hair-care section;

a steam generator having a movable water tank provided to an end of the hair-care section opposite the grip; and a ring which diffuses the steam generated by the steam generator, the ring being provided on the plurality of bristles;

at least one outlet that emits negative ions at a position where the hair crosses the hair holding section, wherein the hair-care section has a bar-like shape, and the heater is fixed to an outer surface of the bar-like shape, wherein the negative-ion generator is built in the grip, and the grip further comprises an outlet opening to the hair-care section to emit the negative ions towards the hair-care section, and wherein the hair-care section is aligned along the same axial line with the grip of bar-like shape, and an opening direction of the outlet is inclined within a range of ten to thirty degrees relative to an axial line of the grip.

10. The hair iron according to claim 9, wherein the bristles are provided at positions farther than a predetermined length from the outlet.

11. The hair iron according to claim 9, wherein lengths of the bristles at positions within a predetermined length from the outlet are shorter than lengths of the bristles at positions farther than the predetermined length from the outlet.

12. The hair iron comprising:

a grip;

a hair-care section connected to the grip, having a heater that generates heat to hair for hair dressing;

a negative ion generator which generates negative ions due to discharge around an electrode therein;

a plurality of bristles provided at an outer plane of the hair-care section;

a steam generator which generates steam;

an ejector which ejects the steam generated by the steam generator, the ejector being provided at the bases of the plurality of bristles; and a ring which diffuses the steam generated by the steam generator, the ring being provided near the bases of the plurality of bristles, wherein the hair-care section has a bar-like shape, and the heater is fixed to an outer surface of the bar-like shape.

* * * * *